United States Patent [19]

DuFort

[11] 4,228,436

[45] Oct. 14, 1980

[54] LIMITED SCAN PHASED ARRAY SYSTEM

[75] Inventor: Edward C. DuFort, Fullerton, Calif.

[73] Assignee: Hughes Aircraft Company, Culver City, Calif.

[21] Appl. No.: 892,721

[22] Filed: Apr. 3, 1978

[51] Int. Cl.[2] ..... H01Q 3/26

[52] U.S. Cl. ..... 343/854

[58] Field of Search ..... 343/854, 853, 100 SA, 343/100 LE

[56] References Cited

U.S. PATENT DOCUMENTS

| | | | |
|---|---|---|---|
| 2,407,169 | 9/1946 | Loughren | 343/854 |
| 3,803,625 | 4/1974 | Nemit | 343/778 |
| 3,964,066 | 6/1976 | Nemit | 343/854 |
| 4,045,800 | 8/1977 | Tang et al. | 343/854 |
| 4,124,852 | 11/1978 | Steudel | 343/854 |

*Primary Examiner*—Eli Lieberman

*Attorney, Agent, or Firm*—John Holtrichter, Jr.; William H. MacAllister

[57] ABSTRACT

A phased array antenna system is disclosed for scanning a narrow beam over a limited angular sector with near optimum performance while using the minimum number of active elements. An input corporate feed is coupled to a "thinned" array of phase shifters. Each phase shifter is coupled to one of a plurality of lossless periodic matrix sub-array feed networks. Radiating elements are coupled in periods such as three elements per period. The output of each phase shifter is selectively coupled to the array of radiating elements within its period and to elements in adjacent periods as well. Such an array permits a plurality of overlapping main beams having low side lobes and grating lobes.

4 Claims, 18 Drawing Figures

Fig. 1.
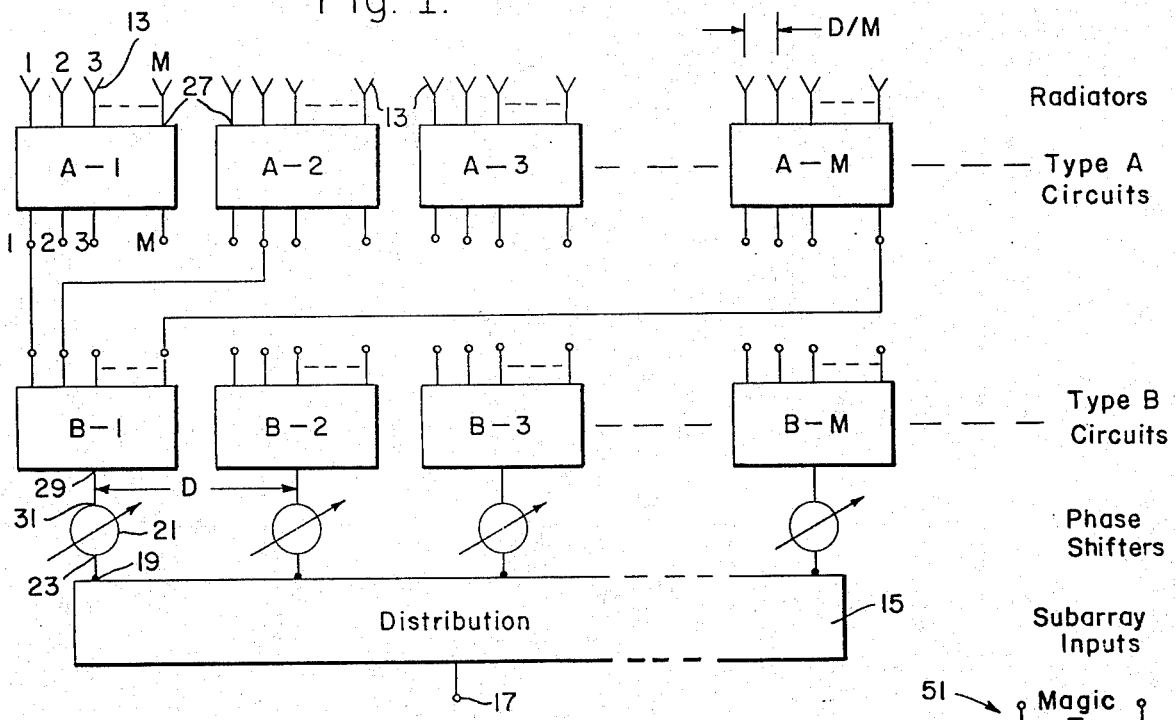
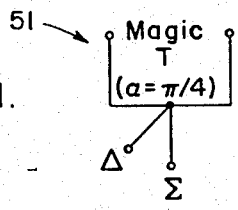
Fig. 4a.
Fig. 4.
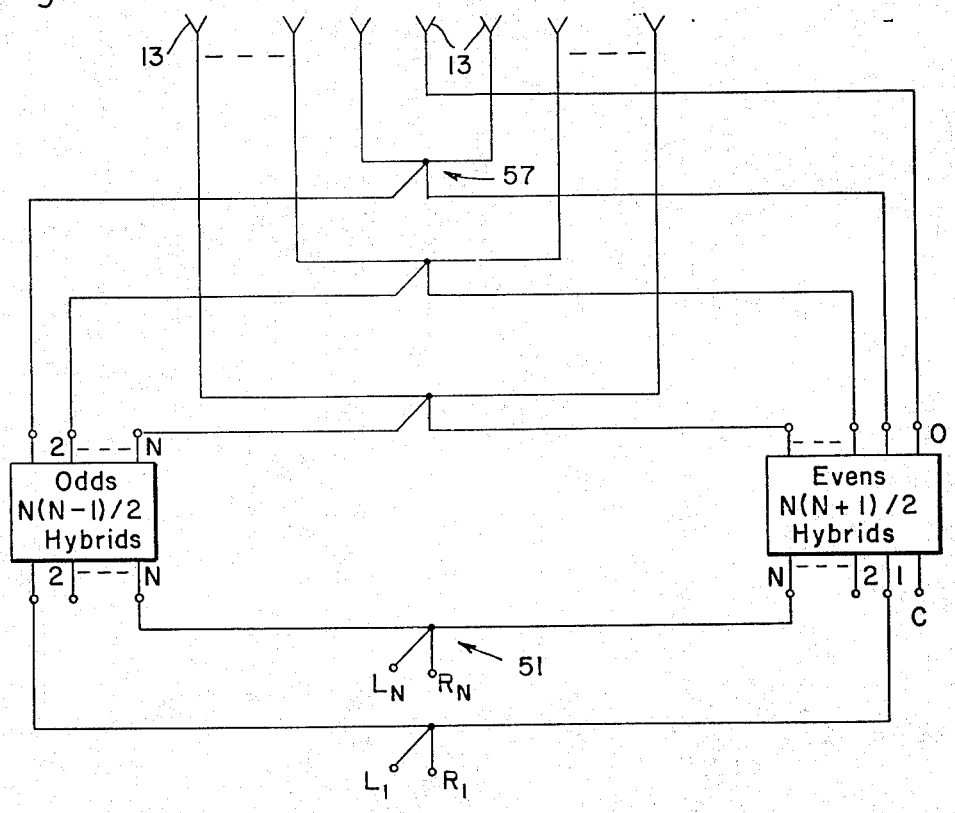

Fig. 2.
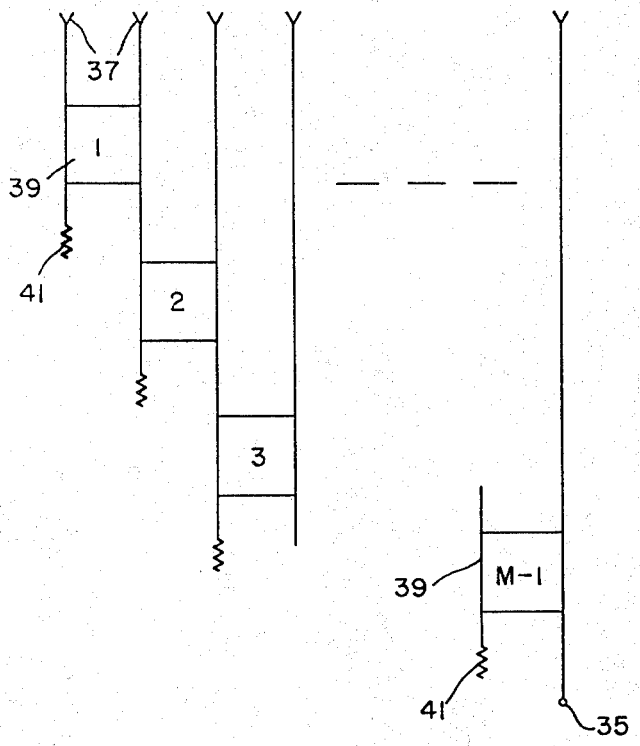
Fig. 2a.
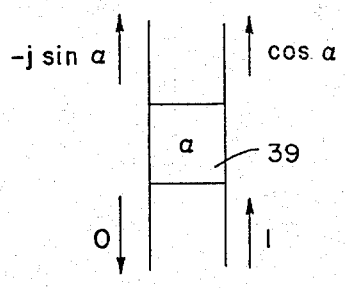
Fig. 3.
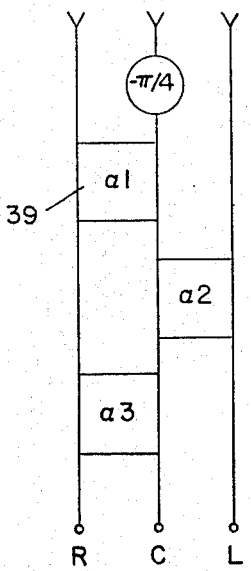
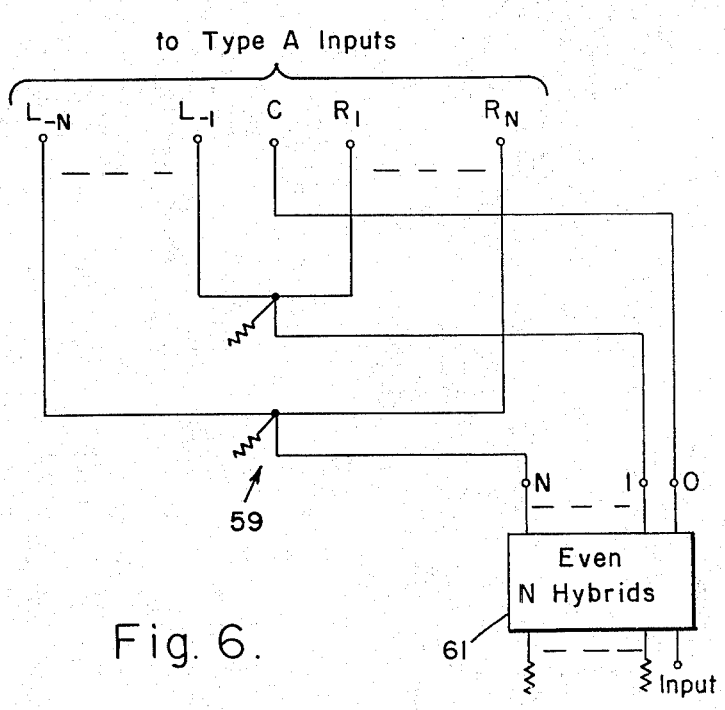
Fig. 6.

LIMITED SCAN PHASED ARRAY SYSTEM

BACKGROUND OF THE INVENTION

The background of the invention will be set forth in two parts.

1. Field of the Invention

This invention relates to antenna systems and more particularly to limited scan phased array antenna systems.

2. Description of the Prior Art

Phased array antenna systems are well known in the prior art. The usual phased array system scans a narrow beam many beam widths within a sector of perhaps ±60° from broadside. A limited scan antenna system which is the subject of the present invention scans a narrow beam only a few beam widths. Limited scan antennas have found application in radars for locating projectiles such as mortar and artillery fire. The object of a projectile locator is to detect and ascertain the location of the source by accurate trajectory measurements early in the flight of the projectile. Thus, this type of radar need only scan a few beam widths from the horizon. High gain beams are required in order to combat noise and minimize multipath effects.

Another application of limited scan antenna systems is in the aircraft approach and landing system, such as a Category III Instrument Landing System (ILS), which allows an aircraft to be flown onto the ground without visual ground reference. Generally an aircraft on ILS approach to landing is flown to within a predetermined distance of landing and to a preselected altitude above the landing spot by reference only to instruments. Upon obtaining visual reference of the runway, the pilot in command lands by reference to the ground. In the advanced ILS, an aircraft may be flown to touchdown without any visual ground reference.

A third application is in the field of satellite communication systems which utilize a high gain antenna having a narrow beam width emanating from the satellite and covering only a portion of the earth. Such coverage may be limited to half a continent. Satellite communications systems with viewing angles of approximately 18° require a small number of beams to cover the earth.

Limited scan antenna systems are generally known in the prior art. An optical antenna which provides limited scan with a minimum number of active elements is the Luneberg lens. The Luneberg lens is spherically symmetric and has the property that a plane wave incident on the sphere is focused to a point on the surface at the diammetrically opposite side. Likewise, a transmitting point source on the surface of the sphere is converted to a plane wave on passing through the lens. Due to the spherical symmetry of the lens, the focusing property does not depend upon the direction of the incident wave. A Luneberg lens may provide a limited number of scan beams by utilizing an equal number of feed horns. Also, this lens may be used in conjunction with an intermediate lens and confocal with an aperture lens. For a more detailed explanation of a Luneberg lens, refer to R. C. Hansen "Microwave Scanning Antennas," Vol. 1, pages 214–218 and 224, Academic Press, New York. U.S. Pat. No. 3,835,469 issued to the assignee herein, describes the utilization of a Luneberg lens with confocal lenses.

One of the drawbacks of optical devices is that they occupy a relatively large volume. Also, this type of optical lens presents deployment and alignment problems such as moving a large Luneberg lens to an operational position while maintaining the proper alignment. Consequently, optical lenses may not be suitable for transportable equipments or systems.

Another antenna network which is well known in the prior art is the Butler matrix, which has the number of active inputs (phase shifters) equal to the number of beams. The Butler system provides ideal performance; i.e., maximum realizable gain consistent with the aperture size and no grating or other spurious lobes. The limitation of the Butler system is that it is very complicated and expensive to build due to the large number of hybrids and transmission line crossovers. For a more detailed explanation of the Butler antenna, refer to "Microwave Scanning Antenna," supra, page 262.

Still another antenna array utilizes a "thinned" array of phase shifters coupling an input corporate feed and an array of sub-array corporate feeds which are in turn coupled to periodic arrays of radiating elements. A "thinned" array refers to an antenna feed system having fewer phase shifters than radiating elements. For example, a prior art thinned array antenna may have a corporate feed with four output elements coupled to four phase shifters. The phase shifter output terminals are in turn coupled to the input terminals of sub-array corporate feeds which are each connected to three radiating elements. The sub-array corporate feeds are coupled only to their respective radiating elements and not to the elements of other sub-arrays. Since the sub-arrays do not overlap, there is no combining loss and all the energy is radiated. Gain degradation occurs due to grating lobes rising as the beam is scanned off the broad side direction. Grating lobes, as is well known, are beams or secondary principle maxima which have an amplitude equal to that of the main beam unless the sub-arrays are properly configured. Grating lobes are caused when the radiation from the elements add in phase in those directions from which the relative path lengths are integral multiples of a wavelength. For six radiating elements per conventional sub-array, there are no grating lobes when the beam is perpendicular to the plane of the radiating elements. As the beam is steered from the perpendicular position, grating lobes begin to appear and their level rises rapidly to −12 dB for an intersub-array phase of 72°.

SUMMARY OF THE INVENTION

In view of the foregoing factors and conditions of the prior art, it is a primary object of the present invention to provide a new and improved limited scan phased array system.

Another object of the present invention is to provide a new and improved periodic and constrained feed for a limited scan phased array antenna system.

Still another object of the present invention is to provide a limited scan phased array antenna system utilizing periodic, lossless and passive circuits providing grating lobe control and high gain.

Yet another object of the present invention is to provide a limited scan phased array antenna system in which the grating lobes are suppressed without significant gain degradation.

A further object of the present invention is to provide a limited scan phased array system which produces 10 dB lower grating lobes and ½ dB higher gain than conventional sub-array techniques.

Still a further object of the present invention is to provide a limited scan phased array system which, in its simplest form, requires only about half the number of phase shifters, drivers, and beam steering active devices as a conventional discrete sub-array system which provides the same grating lobe level.

In accordance with the present invention, there is provided a limited scan phased array system for scanning a narrow beam over a limited angular sector and having a predetermined number T of antenna elements and a distribution network having a common input terminal and a predetermined number P distribution ports P, where T and P are integers and $M=T/P$ and is equal to or greater than 3. The invention includes P phase shifters each connecting at its input discretely from a corresponding one of said distribution ports. Also, included is a lossless sub-array interconnecting network having T output ports and P input ports, each of the output ports being connected discretely to a corresponding one of the antenna elements, and each of the input ports being connected discretely to the output of a corresponding one of the phase shifters.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 1 is a general periodic sub-array circuit in accordance with the present invention;

FIGS. 2 and 2A are, respectively, schematic representations of a hybrid corporate feed and a quadrature hybrid utilized in the present invention;

FIG. 3 is a schematic of a type A network for M=3;

FIGS. 4 and 4A are a type A circuit for M=2N+1 (symmetrical case), and a magic T network, respectively, in accordance with the invention;

FIG. 6 is a type B circuit for M=2N+1 (symmetrical case), in accordance with the invention;

DESCRIPTION OF THE PREFERRED EMBODIMENT

Figure 5:
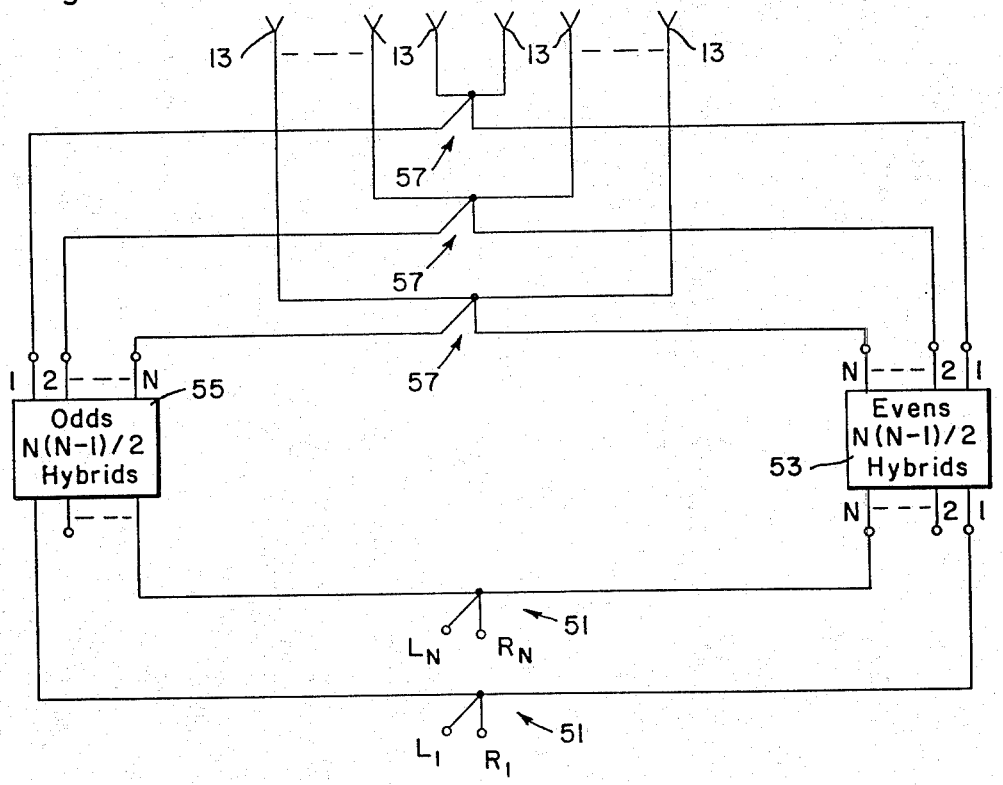
FIG. 5 is a type A circuit for M=2N, symmetrical case.

Referring now to the drawings, and more particularly to the schematic representation of FIG. 1, there is shown a limited scan phased array antenna system 11 for scanning a narrow beam over a limited angular sector and having a predetermined number of antenna elements or radiators 13 and a distribution network 15 having a common input terminal 17 and a predetermined number of distribution ports 19, which number is less than the number of antenna elements. A predetermined number of phase shifters 21 are each connected at their input 23 discretely from a corresponding one of the distribution ports 19. The invention further includes a lossless sub-array interconnecting network 25 having output ports 27 and input ports 29. Each of the output ports 27 are connected discretely to a corresponding one of the antenna elements 13, and each of the input ports 29 are connected discretely to the output 31 of a corresponding one of the phase shifters 21.

In describing the invention in more detail, the general formulation of the sub-array design will be first provided. In uniform periodic sub-arraying feed systems, there are M outputs for each input or each phase shifter. Excitation of a single sub-array terminal produces an output illumination denoted by $f_n$ which may span more than M elements. When several input terminals are excited, the lth terminal input being $z_l$, the output $Z_n$ at the nth terminal will be $$Z_n = \sum_l f_{n-Ml} z_l \tag{1}$$

The total output power is the sum of the squared amplitude $|Z_n|^2$:

$$\begin{aligned}\sum |Z_n|^2 &= \sum_n \sum_l \sum_p f_{n-Ml} f^*_{n-Mp} z_l z_p^* \\ &= \sum_l \sum_p z_l z_p^* \sum_n f_n f^*_{n-M(p-l)}\end{aligned} \tag{2}$$

Since the input power is the sum of $|z_l|^2$, power will be conserved if $$\sum_n f_n f^*_{n-M(p-l)} = \delta_{pl} \tag{3}$$

or, neighboring subarray distributions, all of which are similar in shape but simply displaced, are mutually orthogonal. Conversely, when this condition obtains, there is no loss in the periodic network.

In the limited scan phased array with sub-array terminals separated by a distance D and beam scanned to the angle $\theta_o$, the input has a uniform progressive phase $u_o$ provided by modulo $2\pi$ phase shifters. The input amplitude generally will vary such that $$z_l = a_l e^{-jlu_o}; u_o = kD \sin \theta_o \tag{4}$$

The radiation pattern in the present notation is $$V = E\left(\frac{u}{M}\right) \sum_n Z_n e^{j\frac{nu}{M}}, u = kD \sin \theta \tag{5}$$

where D/M is the spacing of the network outputs and E(u/M) is the active element pattern. The range of u is between $\pm kD$ and ideally the range of $u_o$ is within $\pm\pi$.

If (1) is substituted into (5) with $z_l$ given by (4), the pattern becomes $$V = E\left(\frac{u}{M}\right) \sum_n f_{n-Ml}\, e^{j\left(\frac{n}{M} - l\right) u} \sum a_l e^{jl(u-u_o)} \tag{6}$$

$$= E\left(\frac{u}{M}\right) \sum_n f_n e^{j\frac{nu}{M}} \sum a_l e^{jl(u-u_o)}$$

$$= E\left(\frac{u}{M}\right) F\left(\frac{u}{M}\right) A(u - u_o)$$

where F is the sub-array pattern given by the sum over n, and A is the array pattern given by the sum over l. Positive real sets $\{a_l\}$ produce beams at $u_o$, the principal desired beam, with grating lobes at $u=u_p=u_o+2p\pi$ where $u_p$ lies between $\pm kD$ and p is an integer.

The objective of the present subarray network design is to provide zeros in the function F using lossless networks such that satisfactory grating lobe levels are obtained (with the aid of E perhaps) and the scannable range of $u_o$ is maximized.

The basic building block of the present technique is a hybrid network with M mutually isolated inputs and M outputs. These networks can be used to form M output distributions of vectors which are mutually orthogonal. Given M desired orthogonal output distributions (vectors), the networks can be synthesized as follows. Starting with one of the vectors, a hybrid corporate feed is first constructed which will produce the desired vector. One such corporate feed 33 (this network is not unique) is shown in FIGS. 2 and 2A. It contains 1 input 35, M outputs 37, M−1 hybrids 39, and M−1 loads 41, which are isolated. A second vector is chosen from the desired set. Since it is orthogonal to the first, it can be produced by a smaller corporate feed connected to the M−1 load terminal of the first feed. It will contain M−1 terminals hence M−2 hybrids and M−2 isolated loads. This process is continued until the available number of desired orthogonal vectors is consumed. The resulting network has (M−1)+(M−2) . . . , +2 +1=M(M−1)/2 hybrids 39, all terminals are matched, there are no idle load arms since all arms are either interconnected or appear at the input (lower side in FIG. 2) or the output side; therefore, the network is lossless. This construction for M=3 is shown in FIG. 3 as network 43. Clearly phase shifts can be distributed throughout the network as required to produce complex output vectors. The output vectors are orthogonal in the Hermitian sense, $\overline{A}^*\cdot\overline{B}=0$ instead $\overline{A}\cdot\overline{B}=0$ for real vectors. These networks will be termed type A networks in what follows.

A second network, termed a type B is simply a 1:M power divider or corporate feed which will have at most M−1 distinct hybrids as pointed out above. It will resemble the circuit in FIG. 2. Since this network will always be used with matched loads the hybrids may be replaced by reactive T's.

In either case the infinite line source with periodic sub-arrays is formed as shown in FIG. 1. Type A networks are placed in contiguous linear positions to form an infinite periodic array. Type B networks are placed in contiguous linear positions with the same spacing as the type A circuits. The first terminal of the type B is connected to the first terminal of a type A. The second terminal of the *same type B* is connected to the second terminal of second type A. This connection is continued until the Mth (last) terminal of the type B in question is connected to the Mth (last) terminal of the Mth contiguous type A network. Other type B's are connected in a similar manner to the type A's such that periodicity is maintained. The input 29 to each type B is connected to a phase shifter 21 and the type A outputs 27 are connected to radiating elements 13.

The circuit in FIG. 1 is the most general form of the present sub-array technique. It is clear from FIG. 1 that the sub-array spacing is D, the element spacing is D/M, there are M times more radiating elements 13 than phase shifters 21, and each sub-array aperture illuminating will span $M^2$ radiating elements. Thus, the sub-arrays are M times larger than the sub-array spacing, and the sub-array aperture distributions are identical in shape and periodic in position due to the periodicity of the network. Furthermore, any excitation of the sub-array input terminals 29 will be distributed to the aperture with no loss and will be radiated if the elements are matched for all directions. The sub-array distribution contains $M^2$ elements but is constrained to be that distribution obtained by M segments of M elements each, with the segments being mutually orthogonal; therefore, the sub-array distributions are mutually orthogonal as required by (3). Very importantly, this still leaves a number of degrees of freedom for sub-array pattern control. A hybrid is characterized by one angle (see FIG. 2) such that for unit input, the throughput arm amplitude is cos α. Real aperture distributions can be generated by hybrids with real scattering matrices each hybrid being fully characterized by one angle, or quadrature hybrids with fixed phase shifts can be used. The aperture distribution will have the same number of degrees of freedom as the number of unspecified hybrid (or number of distinct angles) characterizing the sub-array network. Since there are M(M−1)/2 hybrids in the type A circuit and M−1 in the type B the number of degrees of freedom is equal to the total number of hybrids:

$$\text{Number of Hybrids} = \frac{M(M-1)}{2} + (M-1) = (M-1)\left(\frac{M}{2}+1\right) \tag{7}$$

The subarray pattern generally has $(M^2-1)$ zeros but these are constrained to stem from the Fourier transform of a sub-array distribution comprised of orthogonal segments. The actual number of real free zeros equals the number of hybrids given by (7). This can be deduced in another way without direct regard for the network. The M real sub-array segments must satisfy M(M−1)/2 distinct segment orthogonality relations. One of the $M^2$ elements is arbitrary, leaving the following number of conditions to completely specify the distribution $$\text{Number of Remaining Conditions} = M^2 - \frac{M(M-1)}{2} - 1 = (M-1)\left(\frac{M}{2}+1\right) \tag{8}$$

These conditions can be chosen to be real pattern zeros and the available number of zeros is the same as the number of unspecified hybrids.

In practice, real symmetric sub-array distributions for symmetric limited scan are of most interest. The type A networks can be synthesized as described previously with some of the hybrid coupling values being related; however, a direct synthesis using a preliminary odd-/even decomposition is easist to understand and leads directly to the number of available pattern zeros. Consider M to be odd, $M=2N+1$, then the distribution is composed of N segments right of center where the n'th component of the m'th segment is $R_n^m$ and N segments left of center with components $L_p^q$. There is a center segment $C_l$ in this case because M is odd, and for a symmetrical distribution we must have:

$$C_n = C_{-n} \quad (9a)$$
$$R_n^m = L_{-n}^m \quad (9b)$$

Equation (9b ) is satisfied by defining new odd and even functions such that $$R_n^m = E_n^m + 0_n^m \text{ then} \quad (10a)$$

$$L_n^m = E_n^m - 0_n^m \quad (10b)$$

Figure 7:
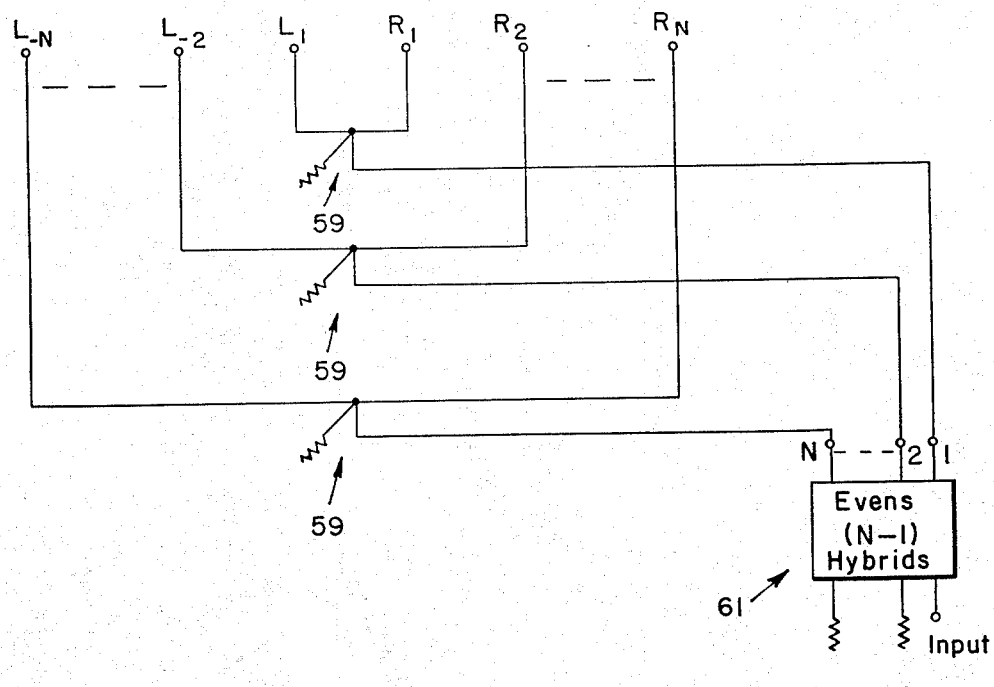
FIG. 7 is a type B circuit for M=2N, symmetrical case.

The network is synthesized as shown in FIG. 4 by first connecting pairs of elements with magic T's 51 ($\alpha=\pi/4$), connecting the evens together in a network of $N(N+1)/2$ hybrids 53 and similarly for the odds using $N(N-1)/2$ hybrids 55. Then the odds and evens are again reconnected through magic T's 57 where right segments are formed using the sum arms as required by (10a) and left segments are formed by using the difference arms as required by (10b). If M is even, $M=2N$, there is no center segment, but otherwise the circuit is similar and is shown in FIG. 5. The type B circuit also has a symmetrical output about the center C; therefore, elements are combined in pairs to the side arms of magic T's 59, and the side arms are connected through hybrid networks 61 of $(M-1)/2$ hybrids for M odd as shown in FIG. 6 or $(M/2)-1$ hybrids if M is even as shown in FIG. 7. The number of available zeros in the sub-array pattern again is equal to the number of unspecified hybrids coupling values and these numbers are apparent from FIGS. 4 to 7. The case $M=2$ degenerates to the usual two element sub-array with no zero control, and $M=1$ is the one phase shifter per element case. Therefore, M must be equal to or greater than 3 in order to have any free pattern zeros. The distinct parts count for the symmetrical case is summarized in the following table.

| Sub-Array Spacing M | Number Elements $M^2$ | No. Hybrids in Even Type A | No. Hybrids in Odd Type A | No. Hybrids in Type B | Total No. Hybrids |
|---|---|---|---|---|---|
| 3 | 9 | 1 | 0 | 1 | 2 |
| 4 | 16 | 1 | 1 | 1 | 3 |
| . | . | . | . | . | . |
| 2N | $4N^2$ | $\frac{N(N-1)}{2}$ | $\frac{N(N-1)}{2}$ | $N-1$ | $(N^2-1)$ |
| $2N+1$ | $(2N+1)^2$ | $\frac{N(N+1)}{2}$ | $\frac{N(N-1)}{2}$ | N | $N(N+1)$ |

Again, the realization is not unique and the circuits in FIGS. 4 to 7 are not necessarily the simplest to build. However, it is clear by inspection that the circuits have the correct properties and are realizable.

For the case $M=3$, the type A circuit shown in FIG. 4 with $N=1$ is applicable. This circuit can be realized with only one unspecified hybrid which can be characterized by a real scattering matrix with two non-zero elements per column, $\cos\alpha$ and $\sin\alpha$. The type B circuit of FIG. 6 with $N=1$ similarly can be chosen to have one available parameter $\beta$. The interconnections of these will lead to a symmetrical sub-array distribution $\{f_n\}$ with three segments, L, C, R of three components each as follows $$\{L\} = \{f_{-4}, f_{-3}, f_{-2}\} = -(1-\sin\alpha)\frac{\cos\beta}{2\sqrt{2}}, \frac{-\cos\alpha\cos\beta}{2}, +(1+\sin\alpha)\frac{\cos\beta}{2\sqrt{2}} \quad (11a)$$

$$\{C\} = \{f_{-1}, f_0, f_1\} = \frac{\cos\alpha\sin\beta}{\sqrt{2}}, \sin\alpha\sin\beta, \frac{\cos\alpha\sin\beta}{\sqrt{2}} \quad (11b)$$

$$\{R\} = \{f_2, f_3, f_4\} = (1+\sin\alpha)\frac{\cos\beta}{2\sqrt{2}}, \frac{-\cos\alpha\cos\beta}{2}, -(1-\sin\alpha)\frac{\cos\beta}{2\sqrt{2}} \quad (11c)$$

Evidently these vectors are mutually orthogonal, produce a symmetrical sub-array distribution without loss, and two free parameters, $\alpha$ and $\beta$ are available for pattern control.

For input signals $a_l \exp(-jlu_o)$ at the l'th sub-array input, the output distribution is $Z_n$ given by $$Z_n = \sum_l f_{n-3l} a_l e^{-jlu_o} \quad (12)$$

Where $a_l$ is unity, $Z_{-n}=Z_n^*$ and $Z_n$ is periodic with period 3:

$$Z_{n+3} = \sum_l f_{n+3-3l} e^{-jlu_o} = Z_n E^{-ju_o} \quad (13)$$

Therefore, it is sufficient to consider only two output amplitudes $Z_{-1}, Z_o$ in evaluating the accuracy of the sub-array technique for the input $\exp(-jlu_o)$. With the aid of (11), (12) becomes $$Z_{-1} = \frac{\cos\alpha\sin\beta}{\sqrt{2}} + (1+\sin\alpha)\frac{\cos\beta}{2\sqrt{2}} e^{-ju_o} - (1-\sin\alpha)\frac{}{2\sqrt{2}} e^{-ju_o} \quad (14a)$$

$$Z_0 = \sin\alpha\sin\beta - \cos\alpha\cos\beta\cos u_o \quad (14b)$$

The infinite array is designed such when $a_l = \exp(-jlu_o)$ $$Z_n \approx \frac{e^{-jn\frac{u_o}{3}}}{\sqrt{3}} \quad (15)$$

If (15) is forced to be a precise equality at a particular value of $u_o=u_{oo}$; then, the output $\{Z\}$ has a perfect phase front of the correct slope. There are no grating lobes and the gain is a maximum. Choose $\alpha$ and $\beta$ such that (15) is satisfied at $u_{oo}$. The imaginary parts of (14a) and (15) yield:

$$\cos\beta = \frac{\sin\frac{u_{oo}}{3}}{\sin u_{oo}}\sqrt{\frac{2}{3}} \tag{16}$$

The real parts of (14a) and (14b) combined with (15) yield:

$$\frac{\cos\alpha\sin\beta}{\sqrt{2}} + \sin\alpha\frac{\cos\beta}{\sqrt{2}}\cos u_{oo} = \frac{\cos\frac{u_{oo}}{3}}{\sqrt{3}} \tag{17a}$$

$$\sin\alpha\sin\beta - \cos\alpha\cos\beta\cos u_{oo} = \frac{1}{\sqrt{3}} \tag{17b}$$

Either (or both) of these equations may be solved for sin $\alpha$ and cos $\alpha$:

$$\sin\alpha = \left[\sqrt{3}\sin\beta + \sqrt{6}\cos\frac{u_{oo}}{3}\cos u_{oo}\cos\beta\right] / 1 + 2\cos^2\frac{u_{oo}}{3} \tag{18a}$$

$$\cos\alpha = \left[\sqrt{6}\cos\frac{u_{oo}}{3}\sin\beta - \sqrt{3}\cos u_{oo}\cos\beta\right] / 1 + 2\cos^2\frac{u_{oo}}{3} \tag{18b}$$

Since sin $\beta$ may be chosen to be positive or negative using (16), there are two solutions for the network parameters $\alpha$ and $\beta$, and both solutions have the same nulls in the sub-array pattern. The ambiguity is resolved by calculating both patterns from the formula:

$$F\left(\frac{u}{3}\right) = f_o + 2\sum_1^4 f_n\cos\frac{nu}{3} \tag{19}$$

and choosing the pattern which provides the most scannability vs. grating lobe level.

The element connected to the output terminals of the type A circuit may be comprised of two half wave spaced elements, each with a matched $\sqrt{\cos\theta}$ pattern connected to the side arms of a magic T. The element pattern is $$E\left(\frac{u}{3}\right) = \left[1 - \left(\frac{u}{6\pi}\right)^2\right]^{\frac{1}{2}}\cos\frac{u}{12} \tag{20}$$

Figure 8:
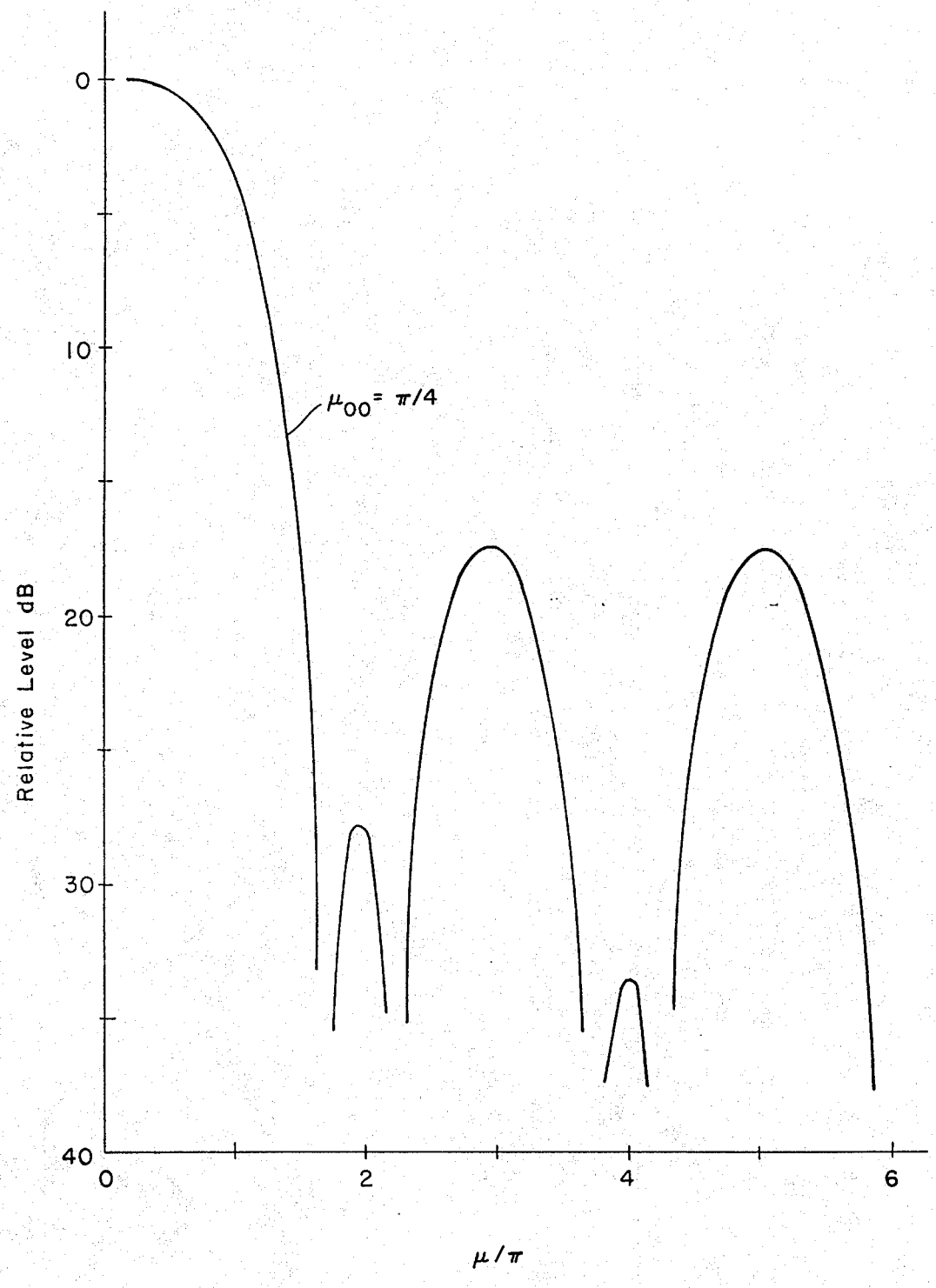
FIG. 8 is a graphical representation showing a sub-array pattern EF vs. u, with $u_{oo}=\pi/4$.

Patterns EF where calculated for various values of $u_{oo}$ using the above technique to determine $\alpha,\beta$ hence $\{f_n\}$. These results were plotted in the range of $|u| \leqq 6\pi$. A typical pattern of $u_{oo}=\pi/4$ is shown in FIG. 8. The broadside grating lobe level is −28 dB for the first grating lobe, and all grating lobes vanish at $u_o=\pm\pi/4$ due to the zeros placed at $2\pi\pm\pi/4$, $4\pi\pm\pi/4$. The first grating lobe level is almost independent of the element pattern E as seen from (20); however, the near end fire lobe is determined almost exclusively by this element pattern. It is easy to design an element which provides even greater suppression of the far out lobes by mismatching the final element for large off axis angles.

Figure 9:
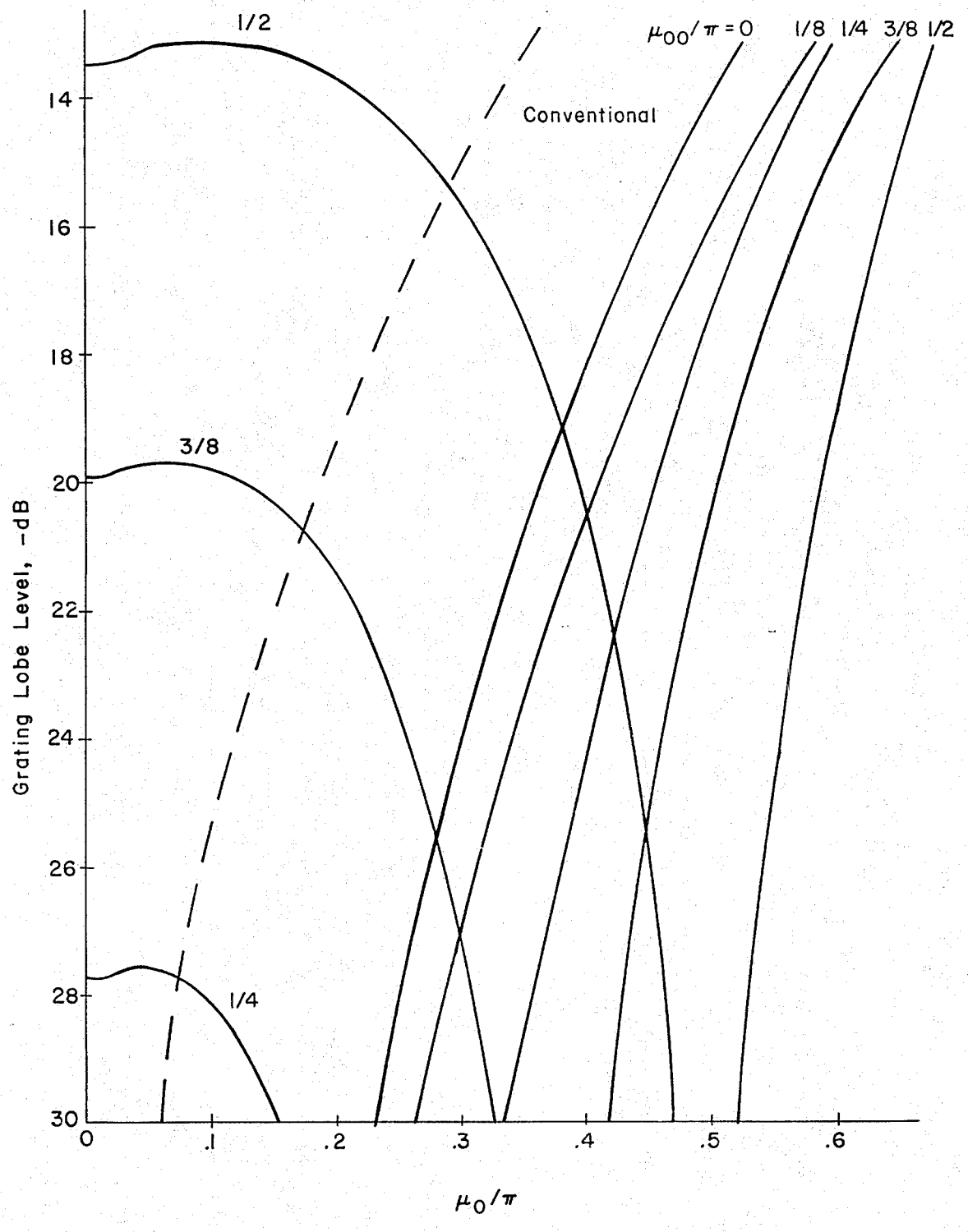
FIG. 9 is a graph showing the level of first grating lobe vs. scan, for various $u_{oo}/\pi$.

Curves showing the level of the first grating lobe vs. scan for various values of the parameter $u_{oo}$ can be constructed from patterns EF such as that shown in FIG. 8 for $u_{oo}=\pi/4$. These results are shown in FIG. 9. As the scan increases from zero, the grating lobe increases slightly from the broadside level then falls to zero at the chosen value of $u_{oo}$ before rising abruptly as shown in the figure. As expected, larger values of $u_{oo}$ allow larger grating lobe levels at broadside. For each $u_{oo}$ there is a grating lobe maximum near $u_o=0$. Scannability for a particular $u_{oo}$ is defined to be the value of $u_o$ where the near broadside grating lobe maximum reoccurs. For example, at $u_{oo}=\pi/2$, the grating lobe maximum near zero scan occurs at $u_o=0.1$ and has the value −13 dB. This value is obtained again for $u_o=0.68\pi$; therefore, the scannability is $(u_o)_{max}=0.68\pi$ which is close to the ideal value $(u_o)_{max}=\pi$. By this definition, the scannability for the case of a double zero in EF at $2\pi$, $u_{oo}=0$, has zero scannability. The curve for the conventional technique, $f_{-1}=f_o=f_{+1}=1/\sqrt{3}$ and $f_{\pm2}=f_{\pm3}=f_{\pm4}=0$ is shown as the dotted curve in FIG. 9. Note that the case $u_{oo}=0$ using the present technique results in grating lobes which are typically 10 dB better for all scan angles. The scannability results taken from FIG. 9 are plotted in FIG. 10 and again compared to the conventional method. For the same grating lobe level, the present method typically allows twice as much scan as the conventional technique.

Figure 10:
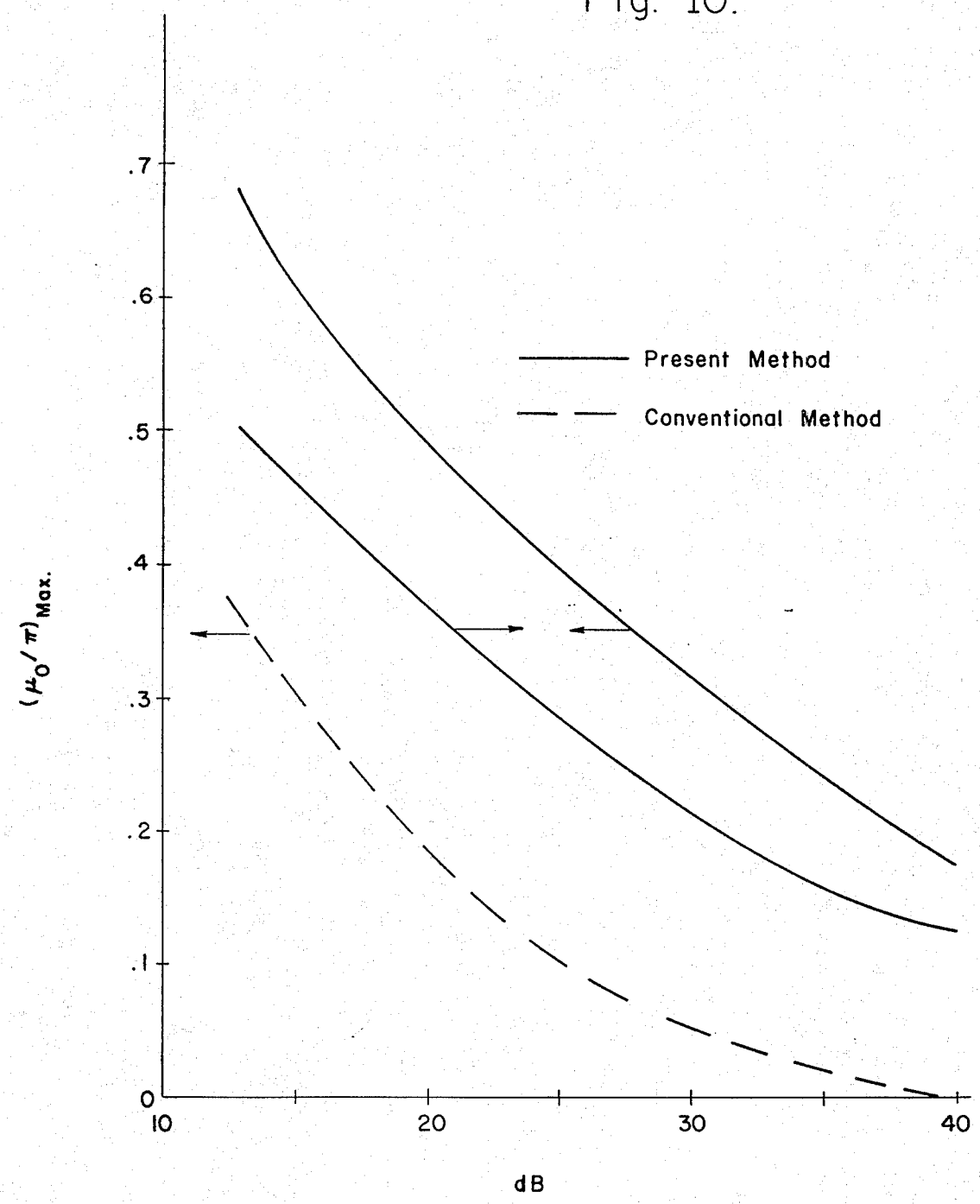
FIG. 10 is a graph of the maximum allowed scan $u_o$ vs. grating lobe level, contrasting the conventional method and the method according to the present invention.

The results in FIG. 10 can be applied to specific design problems once the allowed grating lobe level and maximum desired scan angle are specified. FIG. 10 provides the maximum scannability $(u_o)_{max}=(kD\sin\theta_o)_{max}$ which in turn determines the sub-array size D for specified maximum scan angle $\theta_o$. The corresponding value of $u_{oo}$ read from FIG. 10 may be used to calculate the values of $\alpha$, $\beta$ using (16) and (18) and these two parameters completely determine the network as seen from FIGS. 4 and 6. Instead of these circuits, the circuits of the form shown in FIG. 3 can be used to produce the same results in a planar structure suitable for practical construction. For M=3, and a symmetrical distribution, the planar circuit parameters $\alpha_1\alpha_2\alpha_3$ are not independent. If terminal R is excited the right output is proportional to $f_4$ $$f_4 \sim (-j\sin\alpha_3)(-j\sin\alpha_2) = -\sin\alpha_2\sin\alpha_3 \tag{21a}$$

Similarly exciting the L terminal should produce the same output except at the left $$f_4 \sim (-j\sin\alpha_2)(-j\sin\alpha_1) = -\sin\alpha_2\sin\alpha_1 \tag{21b}$$

Comparing these, it is apparent that $$\alpha_3 = \alpha_1 \tag{22}$$

Furthermore when R terminal is excited, the left output is proportional to $f_2$, $$f_2 \sim \cos\alpha_3\cos\alpha_1 + (-j\sin\alpha_3)(\cos\alpha_2)(-j\sin\alpha_1) \tag{23a}$$

When the L terminal is excited, the right output also should be proportional to $f_2$, $$f_2 \sim \cos\alpha_2 \tag{23b}$$

Figure 11:
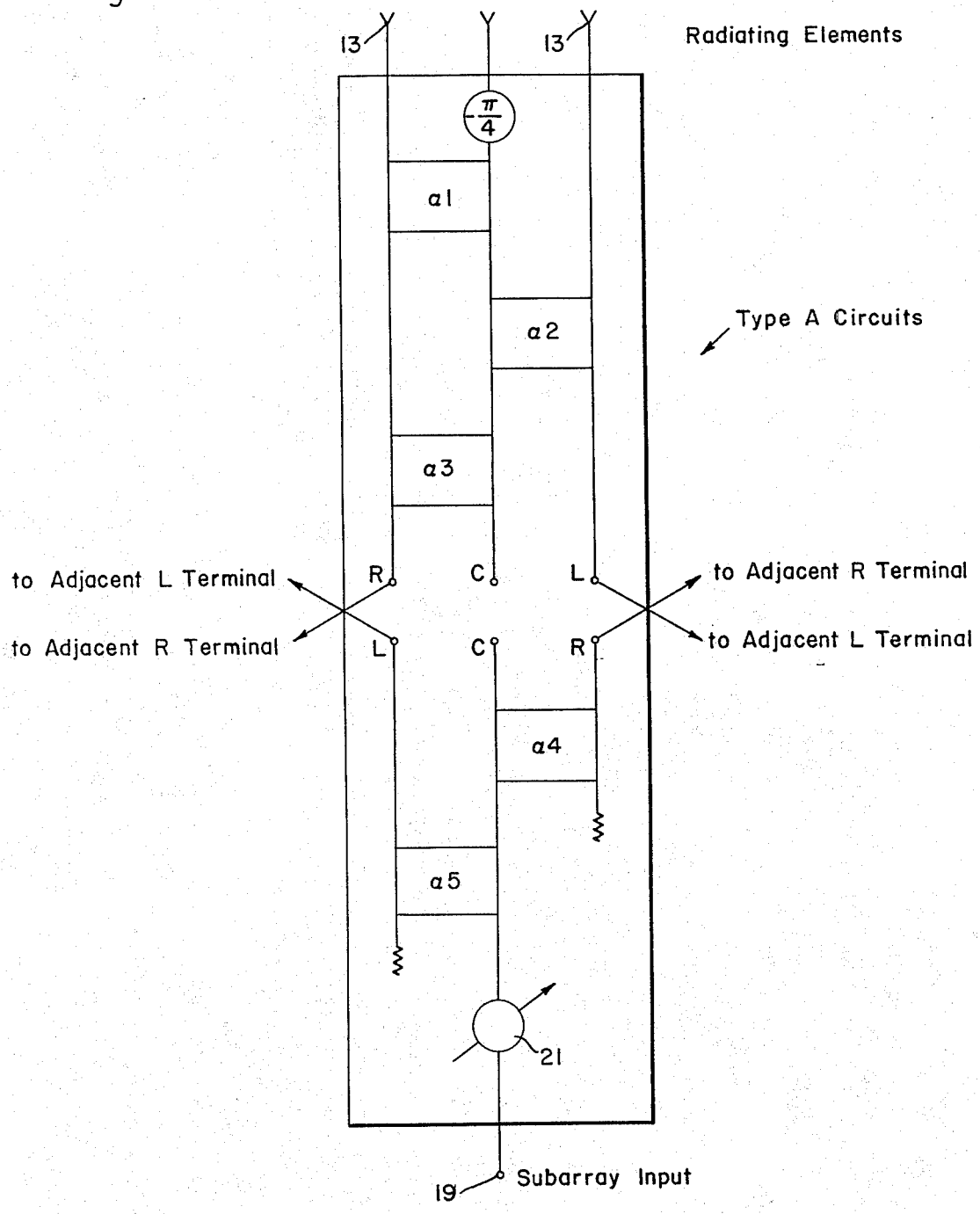
FIG. 11 is a schematic drawing showing a planar module for M=3, symmetrical case.

By substituting (22) into (23a) and comparing with (23b), it is readily found that the two equations are consistent if $$\tan(\alpha_2/2) = \sin\alpha_1; \tag{24}$$

therefore, there is only one free parameter, $\alpha_1$, in the A circuit which can be related to the previous parameter $\alpha$ used in (11). When the L terminal is excited in FIG. 3 the two leftmost outputs are proportional to $f_4$ and $f_3$ such that $$\tan \alpha_1 = f_4/f_3 = \frac{1 - \sin \alpha}{\sqrt{2} \cos \alpha} \tag{25}$$

where the last expression is derived from (11c). A type B power divider may be synthesized similarly in planar form. The composite planar module is shown in FIG. 11. In order that power divide equally into the L and R outputs of the B circuit and the proper amount of power be provided to the C output, the values of $\alpha_4$ and $\alpha_5$ must satisfy $$\sin \alpha_5 = \cos \alpha_5 \sin \alpha_4 = \sqrt{f_2^2 + f_3^2 + f_4^2}\,/f = \frac{\cos \beta}{\sqrt{2}} \tag{26}$$

where the last equality is again derived from (11c). Equations (22), (24), (25) and (26) completely specify the circuit in FIG. 11 in terms of the required scan angle and grating lobe level.

The feed efficiency is most easily analyzed in the receive mode. Incoming signals from the direction $\theta_o$ appear at the aperture side terminals of the type A network in the form $Z_n$:

$$Z_n = E e^{j\frac{nu_o}{3}} \tag{27}$$

Since the transmission coefficient between this terminal and the sub-array terminal on the phase shifter side of the network is $f_n/f$, the received voltage is $$V = E \sum_{-4}^{+4} \frac{f_n}{f} e^{j\frac{nu_o}{3}} = EF/f \tag{28}$$

Ideally, $Z_n = \exp(jnu_o)/3$ instead of (27), and the power available per module is 3. Therefore the efficiency is $$\eta = \frac{|EF|^2}{3f^2} \tag{29}$$

This efficiency quantity includes the effect of the element factor which in this case is of the form $$|E|^2 = |T|^2 \cos \theta_o \cos \frac{u_o}{12} \tag{30}$$

where $\cos u_o/12$ accounts for the combining of the elements in pairs, $\cos \theta$ is the ideal pattern, and $|T(\sin \theta_o)|^2$ is a transmission coefficient which must satisfy an energy conservation relation:

$$\sum_l |T_l|^2 \leq 1 \tag{31}$$

The sum is performed over all real values of $\sin \theta_l$ which satisfy $$\sin \theta_l = \sin \theta_o + \frac{6l\lambda}{D} \tag{32}$$

while D is the sub-array spacing and D/6 is the element spacing at the radiating aperture in the present case. In this section $D = 6\lambda/2$, and $|T|^2$ has been chosen to be unity.

The following is a finite example of an array constructed in accordance with the invention. Consider a 78λ array whose beam is to be scanned 9 standard beamwidths ($9 \times 0.88/78$ rad.) while keeping the grating lobes below 21 dB. Choose a 24 dB design in order to provide a 3 dB margin. The scannability for this case is determined from FIG. 10 to be $(u_o)_{max} = 0.42\pi$. Recall that $(u_o)_{max} = kD \sin \theta_o$; therefore the sub-array spacing is $$\frac{D}{\lambda} \approx \frac{.42\pi}{2\pi} / \frac{9}{2} \times \frac{.88}{78} \approx 4.15 \tag{33}$$

Choose $D/\lambda = 4.1053$ such that the number of modules is the integer 19. Also from FIG. 10 the appropriate values of $u_{oo}$ is $0.3\pi$ which uniquely determines the set of coefficients $\{f_n\}$ using equations (11), (16) and (18). Since the element spacing is wide in the example, $|T|^2$ cannot be unity in all space. Choose $|T|^2$ to be trapezoidal with $|T|^2 = 1$ from broadside out to the points where (32) is satisfied for $\sin \theta_l = \pm 1$ when $l = \pm 1$, and diminishing to zero beyond these points to the edges of the visible region. This form satisfies the energy conservation condition (31) and is a worst case choice since far out grating lobes are enhanced.

Figure 12:
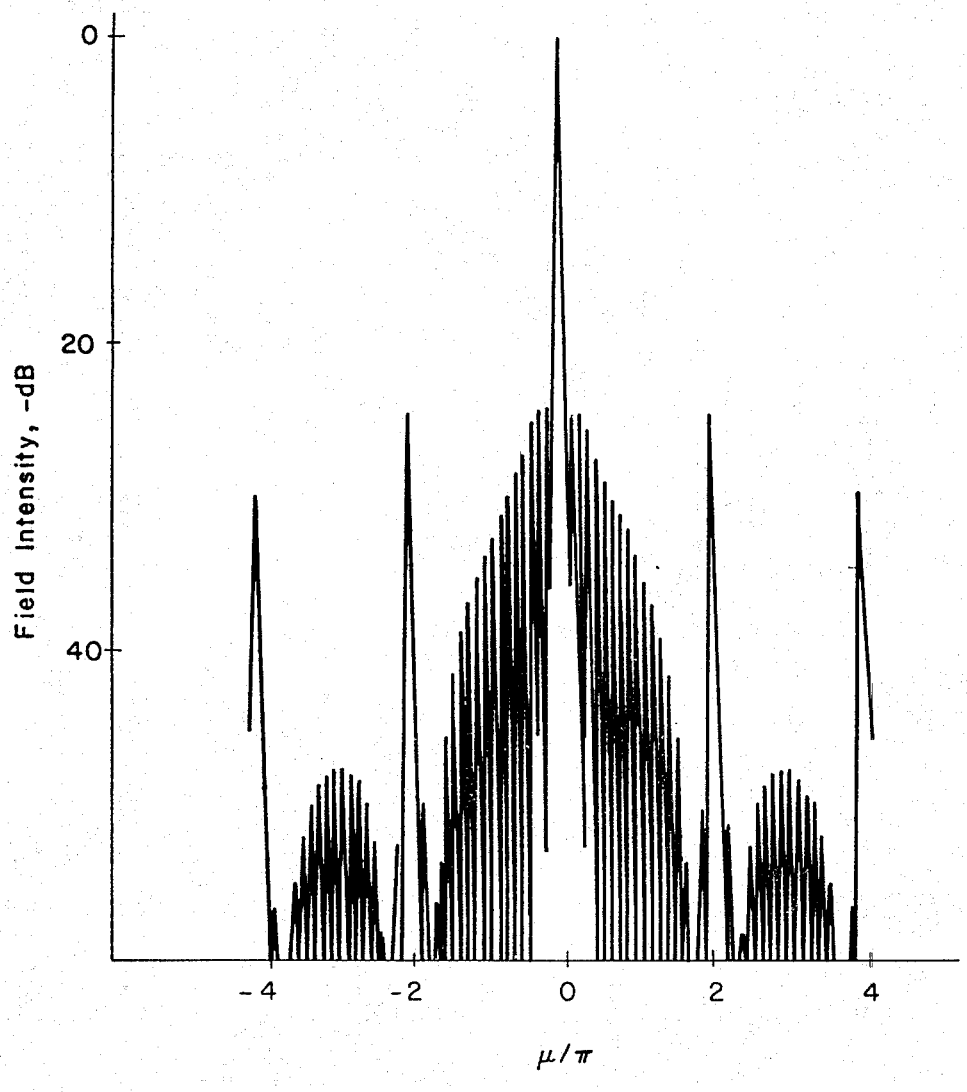
FIG. 12 is a graphical representation of a finite array pattern for zero scan.
Figure 13:
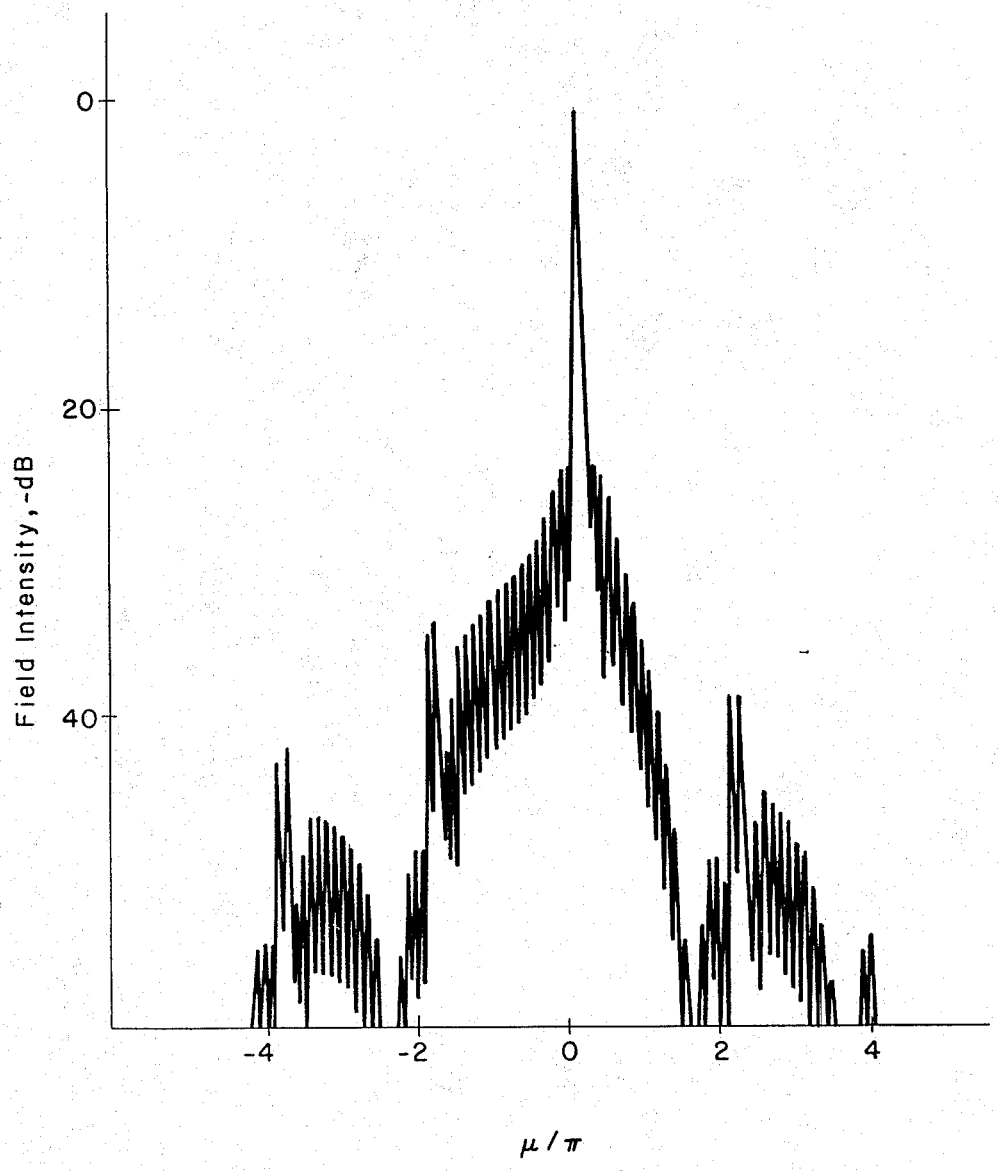
FIG. 13 is a graph showing a finite pattern with beam scanned to $u_{oo}$.
Figure 14:
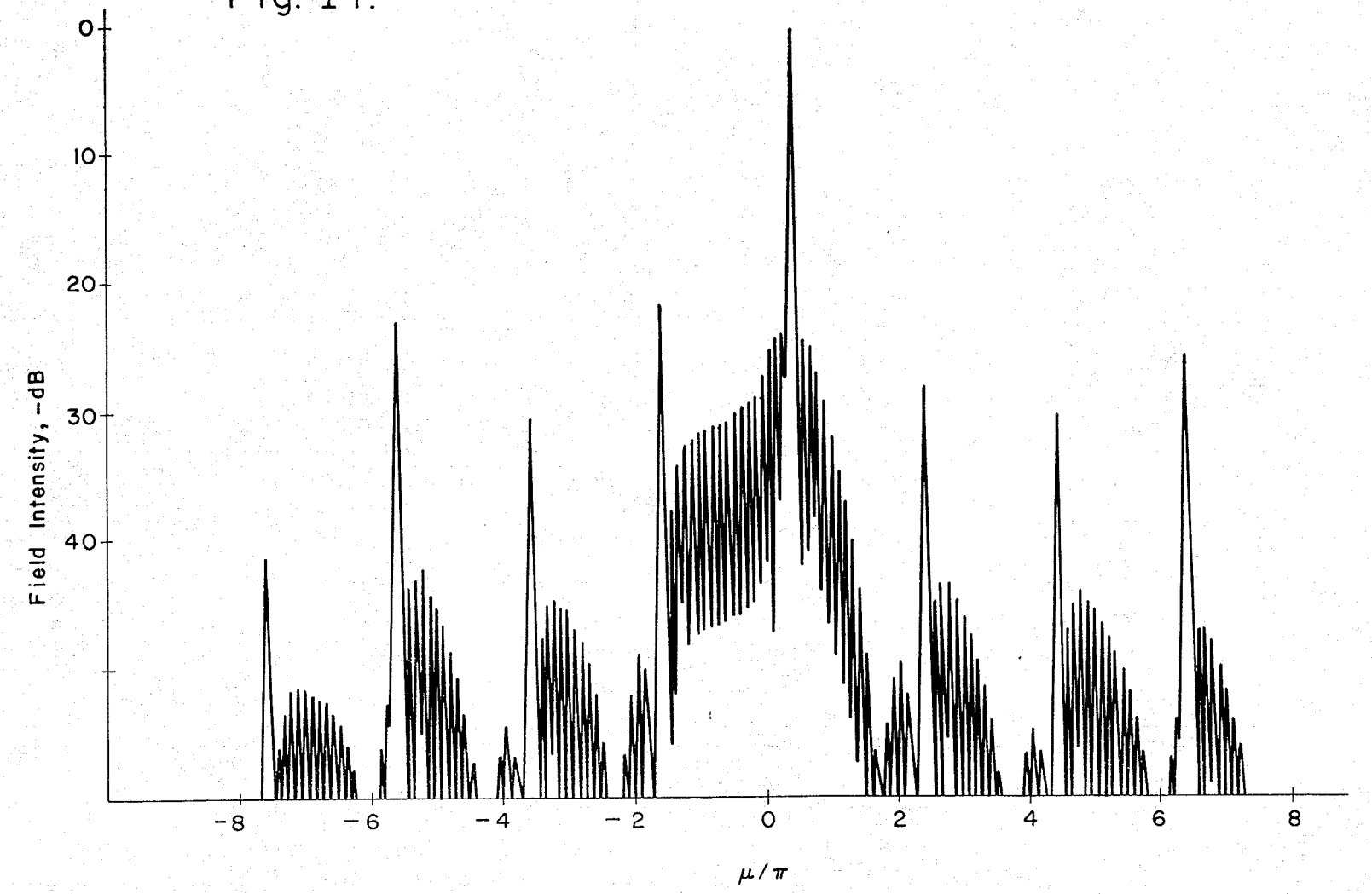
FIG. 14 is a graph of a finite array pattern at maximum scan.

Let the sub-array terminals be excited by signals $a_l \exp(-jlu_o)$, where $a_l$ is chosen to provide a 23 dB Taylor distribution, and $u_o$ is the inter-sub-array phase shift. The pattern is calculated using the general expression (6) where the visible range of u is within ±kD. The broadside pattern $u_o = 0$ is shown in FIG. 12 where the grating lobes are the same as for the infinite case, i.e. −24 dB. The pattern for $u_o = 0.3\pi$ is shown in FIG. 13 where split grating lobes are apparent but substantially reduced below −30 dB due to the nulls in the sub-array pattern at $u = 2l\pi \pm 0.3\pi$. The larger the array the smaller the vestigal grating lobes become. The worst case pattern occurs for $u_o$ at the extreme value and is shown in FIG. 14 where the first grating lobe is only 21.5 dB down instead of 24 dB for the infinite array case. This discrepancy arises because the beamwidth of the array factor is finite and the grating lobe is suppressed only by the steep skirt of the sub-array pattern beam (see FIG. 8 for $u_{oo} = \pi/4$). This displaces the grating lobe slightly and causes a slight rise. The larger the array, the smaller this discrepancy becomes. The far out lobes are controlled by the element E which has a null at $u = 6\pi$ but is otherwise pessimistically chosen. These lobes are however well below the 26 dB design goal as seen in FIG. 14. The efficiency of the sub-array technique at maximum scan is −0.09 and the overall aperture efficiency including Taylor weighting is −0.42 dB.

Figure 15:
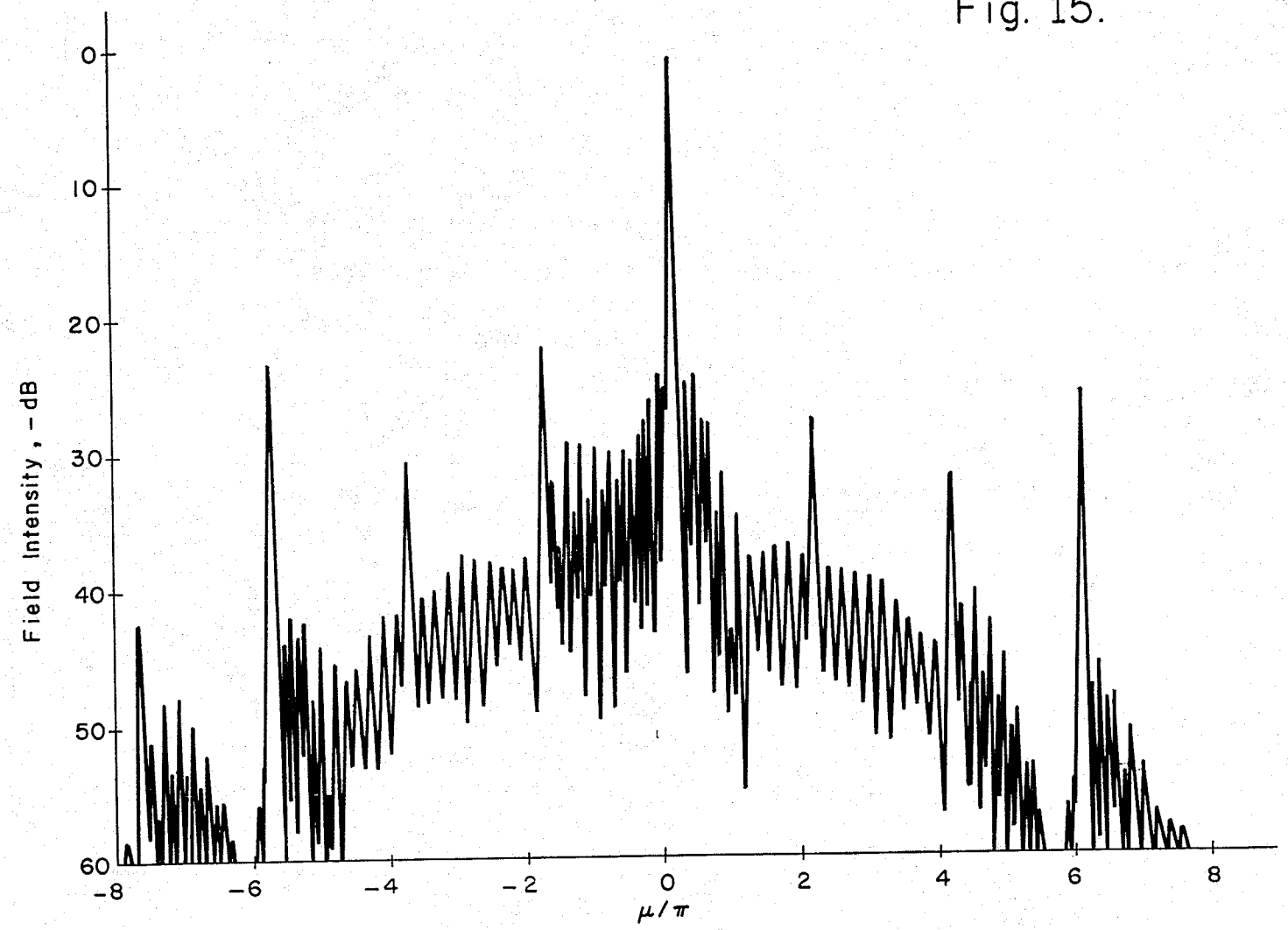
FIG. 15 is a finite array pattern graph at maximum scan with end segments deleted.

In practice, it would be convenient to omit the end modules, i.e. and {L} segment on the left and an {R} segment on the right. The corresponding feed terminals L or R could be loaded with negligible gain degradation, especially when the sub-array weights $a_l$ are highly tapered. The pattern is changed slightly by this deletion as shown in FIG. 15. The first grating lobe goes down about one more dB and the intermediate sidelobes fill up to about −30 dB near the main beam. The reason for this is that the end segments produce an interference pattern arising from two segments 78λ apart. This pattern must be subtracted from the pattern in FIG. 14, and this causes all sidelobes to change slightly.

Figure 16:
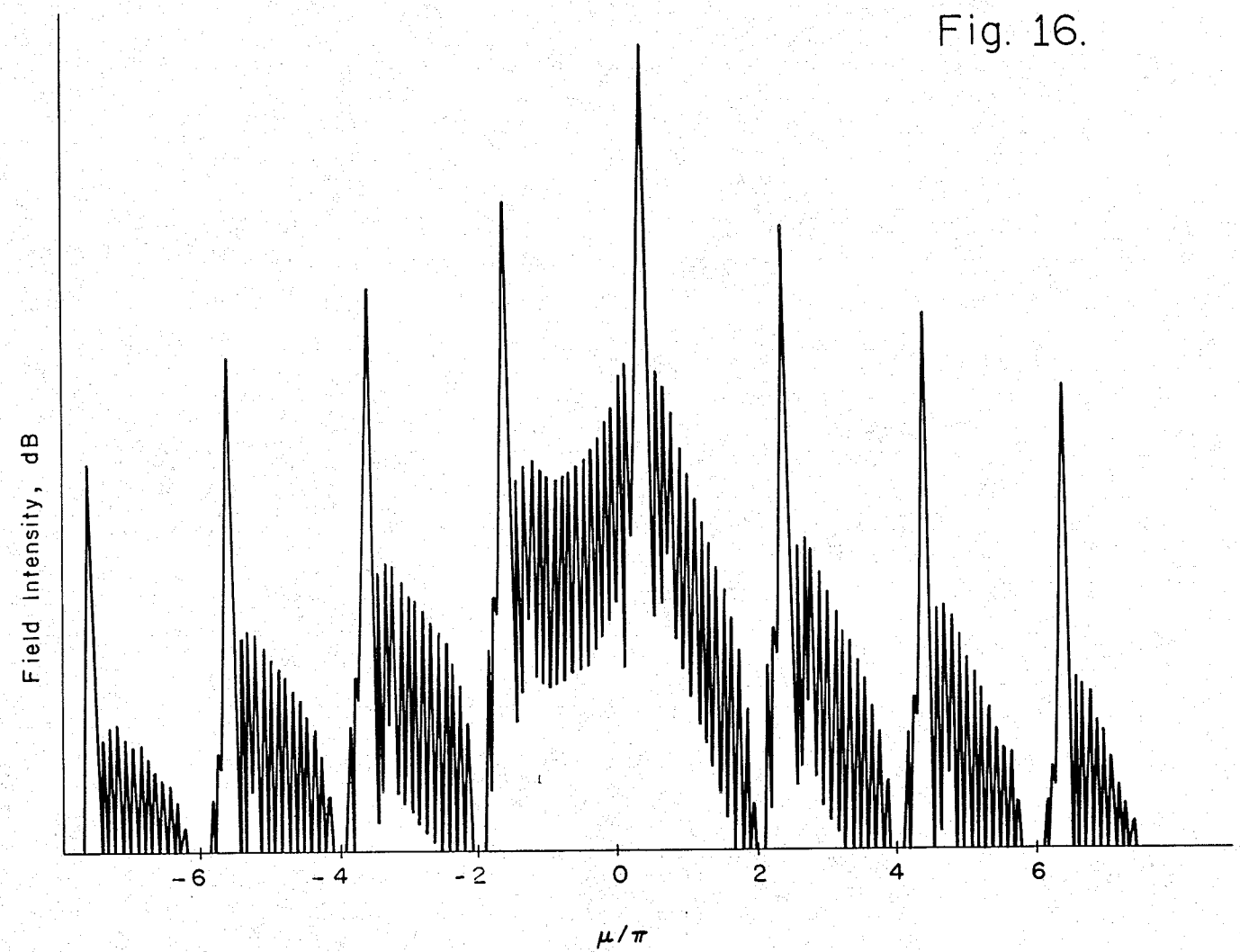
FIG. 16 is a graphical representation of a conventional linear array pattern at maximum scan.

For comparison, a pattern for the conventional sub-array was calculated for the same conditions as the previous case except the function $\{f_n\}$ was $f_o=f_{\pm 1}=-1/\sqrt{3}$ and $f_2=f_3=f_4=0$. The pattern is shown in FIG. 16. Note that the first grating lobe is up to −11.5 dB which is about 10 dB worse than the previous result in FIG. 14. The far out side-lobes are about the same because the element factor is the same in both cases. The sub-array efficiency is −0.62 dB and the total aperture efficiency is about −0.98 dB. This ½ dB gain degradation compared to the results in FIG. 14 is due to the higher grating lobes of the conventional approach. The factor cos u/12 in the element pattern does not contribute significantly to the gain degradation in any of the cases.

It can be seen from the foregoing, that the lossless circuit design with M=3 described above provided ½ dB better gain and at least 10 dB better grating lobe suppression than the conventional discrete sub-array technique employing the same number of sub-arrays. Posed in another way, the scannability of the new design is at least twice as great as the scannability of the conventional design for the same grating lobe level. This allows a two-to-one reduction in the number of sub-arrays, phase shifters, drivers, and beam steering complexity compared to the conventional approach. The new circuit can be realized in a planar geometry suitable for practical construction in stripline which is both inexpensive and compact. The case M=3 can be synthesized from simple analytical expressions knowing only the allowed grating lobe level and maximum scan angle. The circuit design has been generalized to larger sub-arrays which are lossless in all cases.

What is claimed is:

1. A limited scan phased array system for scanning a narrow beam over a limited angular sector, comprising:

a predetermined number T antenna elements and a distribution network having a common input terminal and a predetermined number P distribution ports, where T and P are integers and M equals T/P which is equal to or greater than 3;

P phase shifters each connected at its input discretely from a corresponding one of said distribution ports; and a lossless and passive sub-array interconnecting network having T output ports and P input ports, each of said output ports being connected discretely to a corresponding one of said antenna elements, and each of said input ports being connected discretely to the output of a corresponding one of said phase shifters, said lossless sub-array interconnecting network also including M first hybrid networks and M second hybrid networks, each of said first hybrid networks being a 1:M power divider having M output terminals and an input terminal connected discretely to one of said phase shifters, said predetermined number T antenna elements being equal to M times P.

2. The limited scan phased array system according to claim 1, wherein each of said second hybrid networks includes lossless interconnected 2:1 hybrid power dividers with the same number of outputs as inputs.

3. The limited scan phased array system according to claim 2, wherein all of said input terminals of said second hybrid networks are impedance matched and mutually isolated.

4. The limited scan phased array system according to claim 2, wherein there are M(M−1)/2 of said hybrid power dividers in said second hybrid networks.

* * * * *